US008673134B2

(12) United States Patent
Siporin et al.

(10) Patent No.: US 8,673,134 B2
(45) Date of Patent: Mar. 18, 2014

(54) REMOVAL OF NITROGEN COMPOUNDS FROM FCC DISTILLATE

(75) Inventors: Stacey E. Siporin, Fairfax, VA (US); David Thomas Ferrughelli, Flemington, NJ (US); Steven S. Lowenthal, Flanders, NJ (US); Randolph J. Smiley, Hellertown, PA (US); Alan Roy Katritzky, Gainesville, FL (US); Bruce R. Cook, Aurora, IL (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 482 days.

(21) Appl. No.: 12/908,091

(22) Filed: Oct. 20, 2010

(65) Prior Publication Data

US 2011/0132806 A1 Jun. 9, 2011

Related U.S. Application Data

(60) Provisional application No. 61/283,709, filed on Dec. 8, 2009.

(51) Int. Cl.
*C10G 29/24* (2006.01)

(52) U.S. Cl.
USPC ..... 208/254 R; 208/97; 585/833; 585/864; 585/807

(58) Field of Classification Search
USPC ..... 208/254, 97, 254 R; 585/833, 864, 807
See application file for complete search history.

(56) References Cited

U.S. PATENT DOCUMENTS 3,617,485 A 11/1971 Kittrell
3,974,063 A 8/1976 Owen et al.
4,002,557 A 1/1977 Owen et al.
4,017,475 A 4/1977 Ludwig
4,708,786 A * 11/1987 Occelli ..... 208/120.1
4,746,420 A 5/1988 Darian et al.
4,892,718 A 1/1990 Peter et al.
5,234,670 A 8/1993 Gardner-Chavis et al.
5,462,583 A 10/1995 Wood et al.
5,942,595 A 8/1999 Adelman et al.
6,664,433 B1 * 12/2003 Senzaki et al. ..... 585/864
6,875,341 B1 * 4/2005 Bunger et al. ..... 208/254 R
2004/0118749 A1 * 6/2004 Lesemann et al. ..... 208/211
2007/0149650 A1 6/2007 Masuda

FOREIGN PATENT DOCUMENTS

GB 742097 12/1955
GB 1141328 1/1969
WO 0071494 A1 11/2000

* cited by examiner

*Primary Examiner* — Prem C Singh
*Assistant Examiner* — Brandi M Doyle
(74) *Attorney, Agent, or Firm* — Bruce M. Bordelon; Chad A. Guice

(57) ABSTRACT

A method for the removal of nitrogen compounds from FCC feed or from catalytically cracked distillates including FCC cycle oils by using formaldehyde to selectively couple organic heterocyclic nitrogen species in the FCC feed or FCC distillate to form higher boiling coupling products out of the boiling range of FCC distillate. Removal of the nitrogenous compounds improves the operation of subsequent hydrodesulfurization steps needed for the distillate fraction to conform to low sulfur standards. The formaldehyde is preferably used in the form of paraformaldehyde. The reaction between the nitrogenous compounds in the cycle oil fraction with the formaldehyde is conveniently carried out in the cycle oil pumparound circuit of the FCC main column.

19 Claims, 3 Drawing Sheets

REMOVAL OF NITROGEN COMPOUNDS FROM FCC DISTILLATE

CROSS-REFERENCE TO RELATED APPLICATIONS

This application claims priority to U.S. Provisional Application Ser. No. 61/283,709 filed Dec. 8, 2009, herein incorporated by reference in its entirety.

FIELD OF THE INVENTION

This invention relates to a process for removing nitrogen compounds, especially non-basic nitrogen compounds from catalytically cracked distillates.

BACKGROUND OF THE INVENTION

Environmental concerns have led to decreases in the permissible levels of sulfur in hydrocarbon fuels. While reduction in the maximum sulfur level of road diesel oils from about 0.3 weight percent to 0.05 weight percent were implemented in the 1990s, further significant reductions have since come into effect. In the European Union, the Euro IV standard specifying a maximum of 50 wppm (0.005%) of sulfur in diesel fuel for most highway vehicles has applied since 2005; ultra-low sulfur diesel with a maximum of 10 wppm of sulfur was required to be available from 2005 and was, in fact, widely available in 2008. A final target is the 2009 Euro V fuel standard for the final reduction of sulfur to 10 wppm, which is also expected for most non-highway applications.

In the United States, the Environmental Protection Administration has required most on-highway diesel fuel sold at retail locations in the United States to conform to the Ultra Low Sulfur Diesel (ULSD) standard of 15 wppm since 2006 except for rural Alaska which will transition all diesel to ULSD in 2010. Non-road diesel fuel, required to conform to 500 wppm sulfur in 2007, will be further limited to ULSD in 2010 and railroad locomotive and marine diesel fuel will also change to ULSD in 2012. After Dec. 1, 2014 all highway, non-road, locomotive and marine diesel fuel produced and imported will be ULSD.

The allowable sulfur content for ULSD in the United States (15 wppm) is much lower than the previous U.S. on-highway standard for low sulfur diesel (LSD, 500 wppm). The reduced sulfur content not only reduces emissions of sulfur compounds but also allows advanced emission control systems to be fitted that would otherwise be poisoned by these compounds. These systems can greatly reduce emissions of oxides of nitrogen and particulate matter and according to EPA estimates, emissions of nitrogen oxide will be reduced by 2.3 million metric tonnes (2.6 million short tons) each year and soot or particulate matter will be reduced by 100,000 metric tonnes (110,000 short tons) a year with the adoption of the new standards.

In order to meet these regulations refiners currently use costly high pressure hydrogenative processing to desulfurize the hydrocarbons in the fractions used in road diesel oil, much of which comes from a fluid catalytic cracking (FCC) unit, mainly in the form of the light catalytic cycle oil (LCCO) fraction. Unfortunately, nitrogen compounds in this fraction tend to poison the hydrotreating catalysts and for this reason, refiners may undercut the cycle oil and send the higher boiling fractions with problematic sulfur and nitrogen compounds to the heating oil pool at a significant economic loss. Preliminary estimates suggest that elimination of nitrogen compounds in LCCO could be worthwhile as a way of uplifting the higher boiling LCCO components from the heating oil product to road diesel fuel.

Hydrotreatment of the FCC feed to remove sulfur and nitrogen presents a potential solution with a secondary benefit that basic nitrogen compounds which are known to occupy the active cracking sites of an FCC catalyst would be removed, so enhancing the cracking process and increasing the FCC conversion in addition to increasing the processability of the LCCO in subsequent hydroprocessing. Although FCC feed hydrotreaters are in use with low quality feeds, the volumes of liquid to be processed are large and the units themselves are expensive both in capital and operating costs; for this reason treatment of the FCC feed is not a favored option, at least from the viewpoint of refining economics.

A more economically attractive option would be to remove the problematic nitrogen compounds either from the FCC feed or from the cracked products with the advantage in the second case that a smaller volume of liquid would need to be treated. Following treatment to remove the nitrogen compounds, the distillate stream and/or LCCO could be sent to the hydrotreater for desulfurization.

Acid treatment of FCC naphthas has been proposed in U.S. Pat. No. 7,288,181 for the removal of basic nitrogen compounds, using solid acids such as cation exchange resins and zeolites as well as acids such as sulfuric acid. The acid treatment process is less applicable to the treatment of the nitrogen compounds found in cracked distillates since these higher boiling compounds are generally heterocyclic in nature with the nitrogen atom located in an aromatic ring system in which delocalization reduces the basicity of the nitrogen and its reactivity to acids. The removal of heteroatom-containing impurities from kerogen by extraction using a polar solvent system such as water with formaldehyde is described in U.S. Pat. No. 6,875,341.

SUMMARY OF THE INVENTION

We have now devised a method for the removal of nitrogen compounds from FCC feed or from catalytically cracked distillates, particularly from fluid catalytic cracking (FCC) cycle oils. According to the present invention, formaldehyde is used to selectively couple organic nitrogen species in the FCC feed or FCC distillate, especially the LCCO fraction. The coupling is desirably extensive enough to be able to separate the nitrogen molecules including the non basic nitrogen from the FCC feed or, in the case of treatment of the cracked distillate product, extensive enough to move the organic nitrogen species out of the range of FCC distillate and into the bottoms (fuel oil) stream.

FCC feeds normally contain a significant amount of organic nitrogen compounds that titrate the acid sites of the FCC catalyst, poisoning the sites that could otherwise be used for cracking other molecules. Removal of these nitrogen compounds from the feed will improve the crackability of the feed and increase conversion appreciably as well as positively affecting the hydrotreating costs. If the nitrogen removal is applied to the cracked distillate fraction, the nitrogen compounds which tend to poison hydrotreating catalysts will be selectively removed from the smaller volume of liquid to facilitate subsequent hydrogenative removal of the sulfur compounds.

According to the present invention, we therefore provide a method for the removal of nitrogen compounds from FCC feed or from catalytically cracked FCC distillates boiling above the gasoline boiling range which comprises contacting the FCC feed or the cracked distillate fraction with formaldehyde under conditions to cause coupling of nitrogenous heterocyclics in the FCC feed or cracked FCC distillate fraction to form higher boiling coupling products. The formaldehyde is preferably used in the form of paraformaldehyde and the reaction preferably carried out in the presence of a basic or acidic catalyst.

The preferred method of operation is to contact the light cycle oil distillate fraction from an FCC unit with formaldehyde to affect the coupling of the nitrogenous heterocyclic compounds, after which the higher boiling coupling products can be separated from the reaction effluent, typically by fractionation, to form a fraction of reduced nitrogen content. This fraction may then be hydrodesulfurized under more favorable conditions. The reaction is conveniently carried out in the cycle oil pumparound circuit of the FCC main column, permitting the reaction effluent to be returned to the column for removal of the higher boiling coupling product from the remainder of the cycle oil fraction.

FIGURES

DETAILED DESCRIPTION

Figure 1:
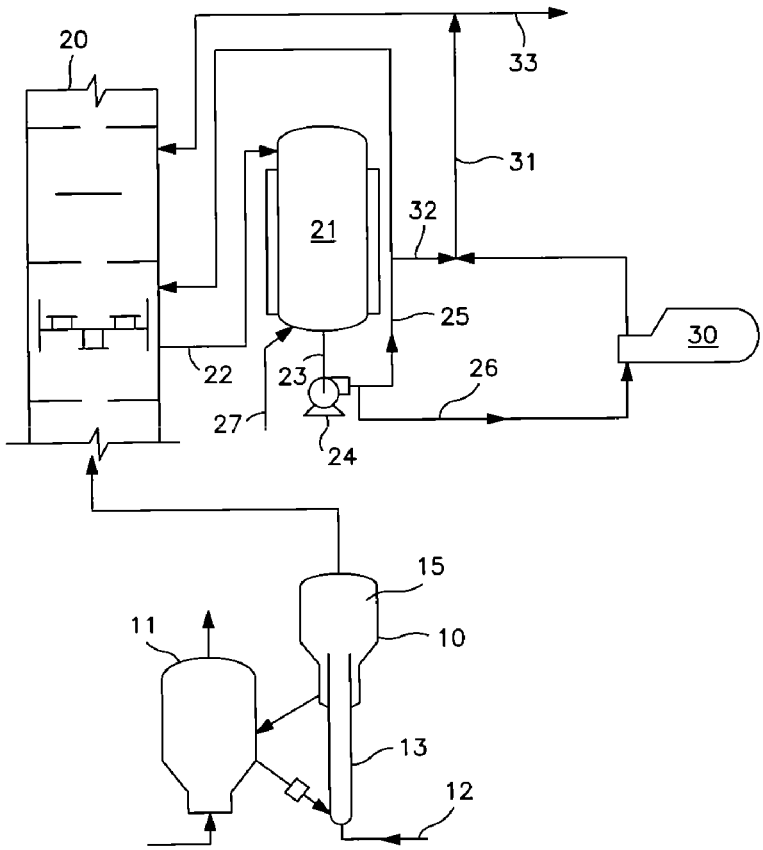
FIG. 1 shows a simplified schematic of an FCC unit with a section for treating the light cycle oil with formaldehyde.

The nitrogen compounds that are commonly found in FCC feeds and cracked distillates include heterocyclic nitrogen compounds which are difficult to remove by conventional processing methods under normal conditions. Compounds such as these, which may be basic or non-basic in character, include, for example, pyridine, methyl pyridine, the picolines (2-, 3- and 4-methylpyridines), indole, 1-methylindole, 2-methylindole, indolenine, isobenzazole, isoindazole, carbazole, N-methylcarbazole, quinoline, isoquinoline, cinnoline, quinazoline, naphthyridine, the pyrido-pyridines as well as compounds containing other heteroatoms, especially oxygen, such as indoxazine, benzoxazole, the isomeric benzoxazines, the isomeric benzisoxazines, anthranil, pyranopyrrole. Even when these compounds do not have any basic nitrogen atoms which would titrate directly with the acidic sites on hydrotreating catalysts, ring opening reactions have the potential to produce inorganic nitrogen which will attach to these sites readily to reduce activity. Thus, the presence of these compounds is potentially a problem when the hydrocarbon fraction containing them is to be hydrotreated.

These compounds may be found in the cracked distillate fraction from the FCC process and may also be present in the FCC feed before they pass through to the distillate product. In either case, the present process acts to remove these compounds from the distillate fraction of the cracked product, either by treatment of the FCC feed or, more preferably, by treatment of the cracked distillate. The removal is achieved by coupling the nitrogen compounds with formaldehyde to form higher molecular weight products, at least dimers, which boil above the road diesel range, approximately 350° C. and can be separated from the cracked distillate by fractionation. In this way, the reaction products will pass into the fuel oil product pool with its more relaxed sulfur specifications.

The FCC distillate range product, normally known as Light Cycle Oil (LCO) or, by the alternative, equivalent term, Light Catalytic Cycle Oil (LCCO) to which the process may be applied will have an initial boiling point above the gasoline range, above about 150° C. (about 300° F.) and in most cases above about 165° C. (about 330° F.). Higher initial points, e.g. 180 or even 200° C. (about 355 or 390° F.) may also be used for this fraction, depending on refinery operations and the applicable product specifications. The selected 90% Point, which is the temperature at which 90 volume percent of the stream (or "fraction") is recovered on distillation, will also depend on refinery and product needs but will typically be in the range of 350 to 450° C. (about 660 to 850° F.) and in most cases from 400 to 425° C. (about 750 to 800° F.). Therefore, unless otherwise stated herein, the terms "LCO" or "LCCO" is defined herein as a FCC product stream having an initial boiling point above 150° C. and a 90% Point less than 450° C. Most cycle oils will fall into the more limited boiling range temperatures noted above. Light cycle oil to be processed into road diesel will be cut to conform to the applicable 90% point limitations in the diesel specification (288° C. for 1-D, 282-338° C. for 2-D, ASTM D975).

For reasons of practicality in handling, the formaldehyde is preferably used in the form of paraformaldehyde; references to the term formaldehyde herein therefore additionally comprehend the use of paraformaldehyde. With a melting point of 120° C. or more, depending on the degree of polymerization, the solid polymer will liquefy at the normal reaction temperatures, enabling effective mixing of the hydrocarbon fraction with the liquefied paraformaldehyde to be obtained. Depolymerization of the paraformaldehyde to monomeric formaldehyde is possible at the preferred elevated reaction temperatures above about 100° C. In the preferred process option in which the LCCO is treated with the formaldehyde reactant, the reaction is suitably carried out in the liquid phase at a temperature from ambient (70° C.) up to about 350° C., preferably from about 150 to 200° C. Pressure can be adjusted to maintain the desired liquid phase but is not critical to the reaction.

In a preferred embodiment of the present invention, at least a portion of the nitrogen heterocyclic compounds boiling in the range of LCO (i.e., boiling in the range of 150° C. to 450° C.) are converted to higher boiling point nitrogen coupling products which boil outside the range of the LCO (i.e., have a boiling point greater than 450° C.). In more preferable embodiments of the present invention, at least a portion of the nitrogen heterocyclic compounds boiling in the range of LCO are converted to higher boiling point nitrogen coupling products with boiling points of at least 500° C., and most preferably at least 550° C.

The amount of formaldehyde relative to the hydrocarbon suitably depends on the quantity of nitrogen compound to be removed which, in turn, can be determined by analysis. Generally, at least one mol of formaldehyde per mol of nitrogen compound is preferred, equivalent to a 100 percent excess, calculated on a bimolecular coupling reaction. Higher ratios of formaldehyde to nitrogen compounds may also be used and if significant excesses are used, the possibility arises of extending the length of the bridges coupling the nitrogen compound entities by additional oxymethylene units.

Although the nature of the reaction which takes place between the nitrogen compound and the formaldehyde is not fully established, analysis has confirmed the production of products of higher molecular weight including those with molecular weights appropriate to coupled reaction products which have been found to be stable to heat and thus amenable to separation by fractional distillation from the hydrocarbon components of the cracked distillate.

The most probable coupling reactions will take place onto the nitrogen or to activated positions on the heterocyclic rings or onto the carbocyclic rings if present. Coupling through the nitrogen of the heterocyclic ring may occur in a reaction similar to the Mannich reaction and for this reason, catalysts active for the Mannich reaction are effective. These catalysts are also believed to be effective at promoting reaction through ring carbons, especially the activated ring positions, for example, the 3-position on the pyrrole ring of the indole molecule or, if the 3-position is blocked, the 2-position, with corresponding reactions on other nitrogen heterocyclics. The coupling reaction may take place with the formation of oxymethylene bridges which may be extended as poly(oxymethylene) bridges with the use of higher amounts of formaldehyde relative to the nitrogen compounds. Indications also exist for the formation of direct methylene bridges between the nitrogenous moieties. Coupling may take place through oxymethylene bridges of one or more units but evidence suggests that coupling through direct methylene bridging may also take place, depending on the reaction pathway, especially at the active positions in heterocyclic rings, e.g. the 3-position of the indole molecule.

The reaction between the nitrogenous compounds and the formaldehyde is promoted by the addition of a catalyst. The catalyst may be acidic, basic or neutral in character; metals may also be effective, Lewis acids and Brönsted acids active for the Mannich reaction may possess utility but normally will not be preferred in view of corrosion problems likely to arise in mild steel equipment.

A preferred group of catalysts comprise the oxides of alkaline earth metals such as magnesium oxide and calcium oxide. Homogeneous catalysts are also preferred for convenience in handling provided that they can be separated from the hydrocarbon phase by normal refinery methods such as distillation, extraction and the like. Nanocatalysts are the preferred solid catalysts because of their high catalytic surface area, especially those with a specific surface area of at least 100 $m^2/g$.

Treatment of the LCCO with the formaldehyde can conveniently be carried out in the cycle oil pump around circuit of the FCC main column. The LCCO pumparound circuit is a reflux loop on the FCC main column in which the LCCO is withdrawn from one level in the column and partly returned as reflux at a higher level. An accumulator is normally provided in the loop and this may be used to carry out the reaction with the formaldehyde. Alternatively, the LCCO can be withdrawn from the column as product and reacted with the formaldehyde in a separate reactor; after the reaction has been carried out to the desired extent, the reaction mixture may be returned to the main column to separate the LCCO fraction from the high boiling condensation product with the formaldehyde. Solid catalyst residues may be filtered off while homogeneous catalysts can be separated out in the column if of suitable boiling point or alternatively, in a separate column following the reactor or the LCCO accumulator. Treatment of FCC feed with formaldehyde can be carried out in a pretreater prior to the FCC unit or to the FCC feed hydrotreater, if present. A simple reaction vessel in which the oil feed can be brought into contact with the formaldehyde at the requisite temperature under agitation at suitable conditions appropriate for the coupling reaction. Although the wide boiling range of FCC feed may effectively preclude separation by fractionation prior to the cracking step, the coupled reaction products have been shown to be thermally stable so indicating the potential for being carried through to the cracked distillate for subsequent separation. This treatment option will not, however, generally be favored in view of the volume of liquid feed requiring to be treated.

FIG. 1 is a simplified illustrative process schematic for carrying out the preferred treatment of the LCO with formaldehyde. A FCC unit (shown on a reduced scale), incorporating a reactor section 10 and a regenerator section 11 of conventional type, is fed with a preheated FCC feed through line 12. The feed is cracked by contact with the hot catalyst coming from regenerator 11 in riser reactor 13 with disengagement of the cracking products from the catalyst in reactor/disengager 15. The catalyst returns to regenerator 11 to be oxidatively regenerated while the cracking products are taken to the FCC fractionator main column, a portion of which at the level of the LCO draw is shown schematically at 20. The cracking products from the reactor enter the column near its lower end by means of a connecting line (indicated schematically) from reactor/disengager 15. The cracking products are separated into fractions in the main column with further fractionation taking place in side columns (not shown) for finer cut points to be established, e.g. for light naphtha, heavy naphtha, etc. according to conventional practice and refinery product cut point requirements.

The LCO fraction is withdrawn at its appropriate level in the main column and conducted to LCO accumulator 21 by way of line 22. Accumulator 21 is preferably insulated and optionally heated as required to maintain the LCO at a suitable temperature for the reaction with the formaldehyde, as discussed above. Formaldehyde and catalyst may be introduced through feed line 27 in the appropriate amount relative to the cycle oil feed. Residence time in the accumulator is adjusted to permit the reaction between the nitrogenous components of the LCO to react with the formaldehyde by control of the outflow through line 23 relative to the inflow from the main column. The treated LCO is returned to the main column by means of the LCO pump around circuit including pump 24 and line 25 which enters the main column at a higher level. A portion of the LCO product which includes the formaldehyde reaction products is withdrawn from the pump around circuit by way of line 26 and taken to reboiler heater 30 before being returned to the column as reflux at a higher level through line 31 with additional LCO from the pumparound entering through line 32 as reflux. The majority of the coupling products formed by the reaction with the formaldehyde will be returned to the main column in the return lines 25, 31 and will be separated in the main column from the LCO fraction as a consequence of their higher boiling point. LCO is withdrawn as product for further processing through product take-off line 33 and can be taken to the hydrotreater for desulfurization using less severe conditions as noted above as a consequence of the removal of the coupling products between the nitrogenous heterocyclics and the formaldehyde.

Although not specifically shown in FIG. 1, in a modified embodiment of the configuration shown in FIG. 1, a pump may be alternatively located at a point on line 22 (LCO draw) wherein the pump discharge is split to send a portion of the stream in line 22 directly to product (line 33), while sending a portion of the stream in Line 22 to accumulator 21. In this manner, only the treated LCO is returned back to the FCC fractionator main column for further separation.

If the LCO is removed from the FCC fractionator main column and conducted to a separate reactor other than the cycle oil accumulator to carry out the formaldehyde coupling reaction, the product from this reactor may be returned to the main column for fractionation to remove the higher boiling coupling products or, alternatively, sent to a separate cycle oil fractionator in which the separation can be carried out. These alternatives will not, however, normally be favored in view of their additional hardware requirements.

Following the coupling treatment and separation of the higher boiling fraction containing the coupled species, the treated LCO may be subjected to hydrodesulfurization in the conventional manner although the potential exists for operating at less severe conditions than without the coupling in view of the removal of the catalyst poisons by the coupling reaction; also, there is a potential for a longer catalyst life.

The effluent from the separation step is treated under effective hydrotreating conditions to produce the desired desulfurized product, e.g. to achieve a resulting desulfurized diesel boiling range product having a sulfur content enabling regulations to be met. Hydrotreating conditions typically include temperatures ranging from about 200° C. to 370° C., preferably about 230° C. to 350° C. Typical weight hourly space velocities ("WHSV") range from about 0.5 to about 5 $hr^{-1}$, more usually from about 0.5 to about 2 $hr^{-1}$. Pressures typically range from about 10 to about 100 atmospheres, preferably 20 to 40 atmospheres. Typical hydrodesulfurization catalysts are used, for example, Co—Mo on a base of alumina or silica-alumina.

EXAMPLE 1

Formaldehyde treatment was carried out using indole as a model compound. Indole is a nonbasic organic compound that boils in the distillate range (253° C., 487° F.).

Indole (0.0142 moles) was dissolved in toluene followed by addition of 2 cc formaldehyde (37 wt. % solution, 0.0246 moles). A basic catalyst, MgO nanopowder, 0.01 g, was also added. The initial reaction was run at room temperature and stirred overnight. To monitor the reaction the starting solution was injected into a HP 5890 GC® to monitor loss of the indole peak. After stirring overnight no observable reaction took place. After this time another 2 cc of formaldehyde was added to the flask and the temperature was raised to 80° C. and held for 4 hrs. The gas chromatograph (GC) revealed a drop in the indole concentration and the appearance of a peak at a higher retention time. Another 4 cc of $CH_2O$ was then added and stirred at 80° C. for an additional 4 hrs. After this time the indole peak had disappeared as well as the first observable new peak. In its place was a new peak at a much higher retention time. An orange liquid was now observed in the reaction flask.

In order to recover reaction products the contents were poured into a separatory funnel to separate three phases. Top phase—Toluene layer (slightly yellow). Middle phase—$H_2O$ layer (slightly yellow). Bottom phase—Orange viscous layer which was not soluble in toluene but was soluble in dichloromethane. It was determined that the orange viscous layer contained a significant amount of indole that had been polymerized by the formaldehyde.

EXAMPLE 2

The coupling reaction was observed in a typical LCO (700 ppm nitrogen, mostly carbazoles, IBP-FBP: 168-427° C., 335-800° F.). The reaction was carried out using excess paraformaldehyde (12 ml, 23.5× excess based on 700 ppm nitrogen and 154 MW in 30 g LCO) and an MgO nanocatalyst (0.05 g) at 165-175° C. for 10 hours in an autoclave at approx 350 kPag (50 psig). The coupled products were analyzed by electrospray ionization mass spectrometry (ESI-MS, positive ion), total nitrogen after distillation and C-Simdist (simulated distillation). The coupled products were distilled using a 15 theoretical plate column with a 5:1 reflux ratio to 50% off and HiVac to 90% off to obtain the heaviest 10 wt % of the sample. The coupled products were stable enough to withstand the 190-260° C. (375-500° F.) temperature for 2 hours during the distillation.

The total nitrogen analysis was as shown in Table 1 below:

TABLE 1

| | Nitrogen in Fresh LCO (ppm) | Nitrogen in Treated LCO (ppm) |
|---|---|---|
| Full LCO | 653 | 739 |
| IBP-90% | 508 | 487 |
| 90%+ | 1917 | 3537 (1) |

Note:
(1) Viscous product

These results show that there is a reduction in the nitrogen content of the front end of the LCO coupled with a significant increase in the high boiling fraction, indicative of a transfer of nitrogenous species to the higher molecular weight fraction.

Figure 2:
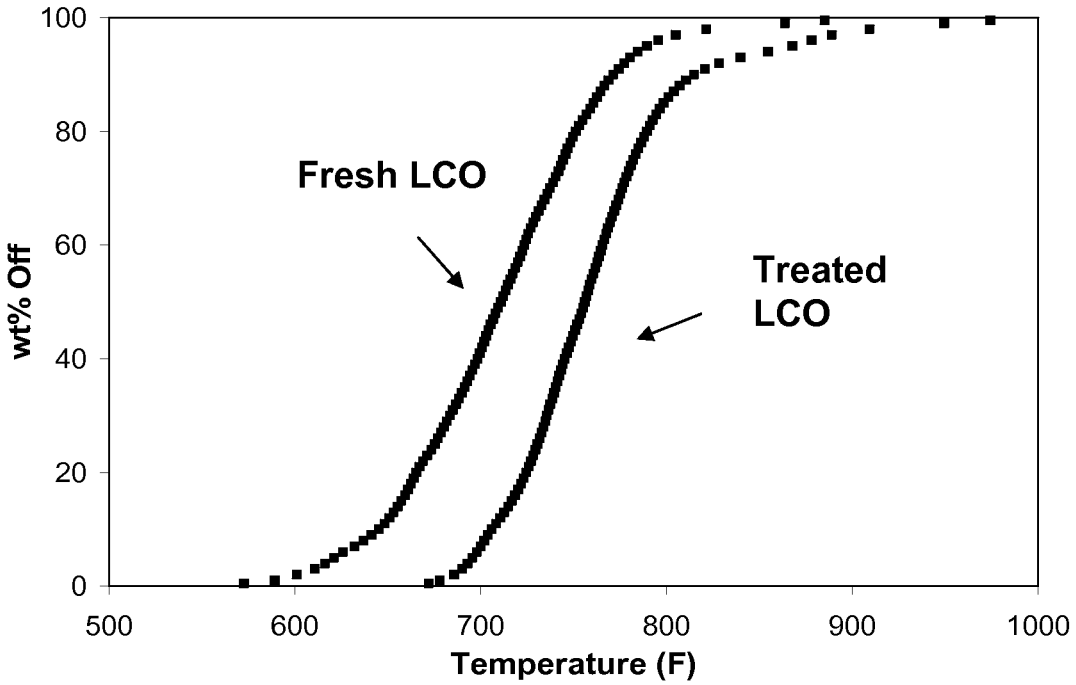
FIG. 2 shows the results of a simulated distillation of the 90%+ fraction of an untreated LCO and a treated LCO.
Figure 3:
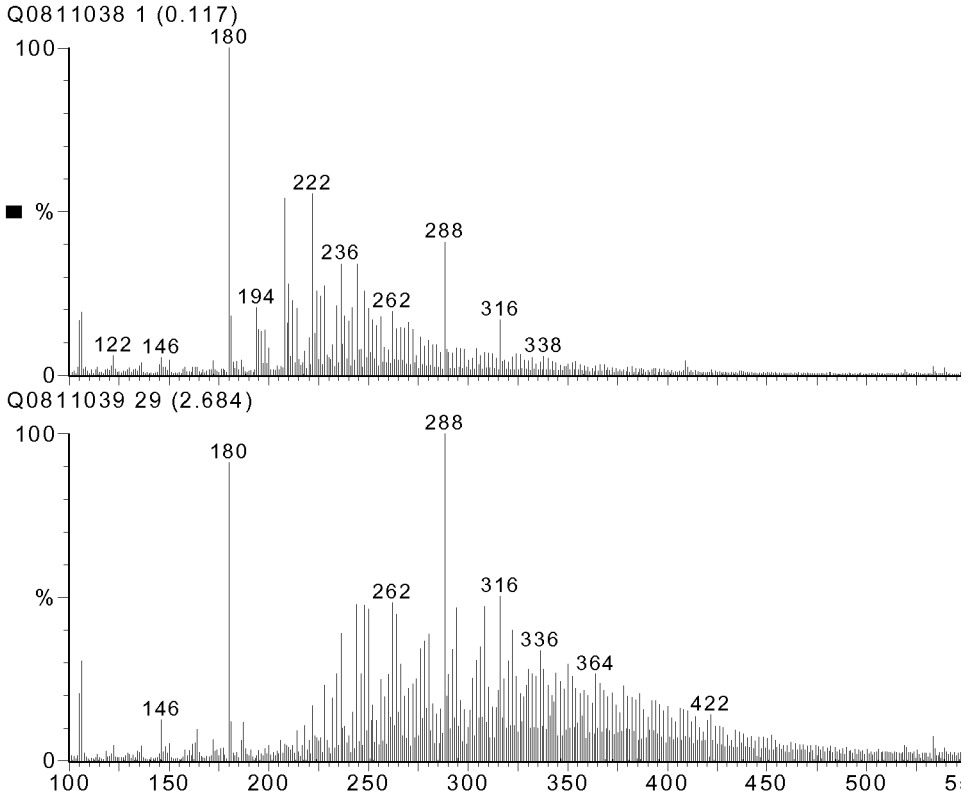
FIG. 3 shows the results of an ESI-MS analysis of an untreated LCO and a treated LCO.

The simulated distillation curves for the untreated and treated LCCO products (of the 90%+fraction) given in FIG. 2 show a shift of about 30° C. (50° F.) in the boiling range of the 90%+ volume fraction of the LCO, indicative of a sufficient shift to allow distillation to be utilized for separation of the coupled species from the untreated LCO. The ESI-MS analyses in FIG. 3 which plot molecular weight on the x-axis against response. In FIG. 3, the upper spectrum represents the 90%+ fraction of the LCO before the coupling reaction and the lower spectrum, the treated fraction. The line at molecular weight of 180 is from the stearic acid used as an internal standard. A significant increase in the higher molecular weight species at longer retention times is present following the coupling reaction.

What is claimed is:

1. A method for the removal of nitrogen heterocyclic compounds from a hydrocarbon petroleum fraction comprising an FCC (fluid catalytic cracking) feed or catalytically cracked FCC distillate fraction containing nitrogen heterocyclic compounds which method comprises:

a) contacting the FCC feed or the catalytically cracked distillate fraction with formaldehyde in the presence of a basic catalyst and under conditions to cause coupling of at least a portion of the nitrogen heterocyclic compounds in the FCC feed or catalytically cracked FCC distillate fraction to form nitrogen coupling products which have a boiling point higher than the nitrogen heterocyclic compounds, the contacting conditions including a temperature of at least about 150° C.; and b) separating at least a portion of the nitrogen coupling products from the catalytically cracked FCC distillate fraction by fractionation.

2. A method according to claim 1, wherein the formaldehyde is contacted with a catalytically cracked FCC distillate fraction comprising a light catalytic cycle oil.

3. A method according to claim 2, wherein the light catalytic cycle oil has an initial boiling point of at least 150° C. and a 90% boiling point of less than 450° C.

4. A method according to claim 3, wherein the light catalytic cycle oil has an initial boiling point of at least 165° C.

5. A method according to claim 1, wherein the formaldehyde is used in the form of paraformaldehyde.

6. A method according to claim 2, wherein the light catalytic cycle oil is contacted with formaldehyde at a temperature from about 150° C. to about 350° C.

7. A method according to claim 1, wherein at least a portion of the nitrogen heterocyclic compounds boil within the range of 150° C. to 450° C. and at least a portion of the nitrogen coupling products boil above 450° C.

8. A method according to claim 1, wherein the light catalytic cycle oil is contacted with formaldehyde in the presence of an alkaline earth metal oxide catalyst.

9. A method for producing a catalytically cracked petroleum product of reduced sulfur and nitrogen content which comprises:

a) contacting a light catalytic cycle oil fraction from an FCC (fluid catalytic cracking) unit with formaldehyde in the presence of a basic catalyst under conditions including a temperature of at least about 150° C. to cause coupling of at least a portion of nitrogen heterocyclic compounds in the light catalytic cycle oil fraction to form an effluent containing nitrogen coupling products which have a boiling point higher than the nitrogen heterocyclic compounds, the catalyst comprising a homogenous catalyst or catalyst particles;

b) separating at least a portion of the nitrogen coupling products from the effluent by distillation to form a reduced nitrogen light cycle oil which has a lower nitrogen content by wt % than the light catalytic cycle oil fraction; and c) hydrodesulfurizing at least a portion of the reduced nitrogen light cycle oil.

10. A method according to claim 9, wherein the light catalytic cycle oil has an initial boiling point of at least 150° C. and a 90% boiling point of less than 450° C.

11. A method according to claim 9, wherein the formaldehyde is used in the form of paraformaldehyde.

12. A method according to claim 9, wherein the light catalytic cycle oil is contacted with formaldehyde at a temperature from about 150° C. up to about 350° C.

13. A method according to claim 12, wherein the light catalytic cycle oil is contacted with formaldehyde at a temperature from about 150 to 200° C.

14. A method according to claim 9, wherein at least a portion of the nitrogen heterocyclic compounds boil within the range of 150° C. to 450° C. and at least a portion of the nitrogen coupling products boil above 450° C.

15. A method for producing a catalytically cracked petroleum product of reduced sulfur and nitrogen content which comprises:

a) catalytically cracking a heavy oil feed in an FCC (fluid catalytic cracking) unit to form catalytically cracked products including a naphtha fraction and a light cycle oil fraction containing nitrogen heterocyclic compounds;

b) fractionating the catalytically cracked products in a fractionation column to form a catalytically cracked light cycle oil fraction wherein at least 90 wt % of the fraction boils in the range from 150° C. to 450° C.;

c) contacting the catalytically cracked light cycle oil fraction in a reaction vessel with formaldehyde in the presence of a basic catalyst under conditions including a temperature of at least 150° C. to cause coupling of at least a portion of the nitrogen heterocyclic compounds in the catalytically cracked light cycle oil fraction to form a total effluent containing nitrogen coupling products which have a boiling point greater than the nitrogen heterocyclic compounds;

d) separating the nitrogen coupling products which have a boiling point greater than the nitrogen heterocyclic compounds from the total effluent by distillation to form a reduced nitrogen light cycle oil which has a lower nitrogen content by wt % than the catalytically cracked light cycle oil fraction; and e) hydrodesulfurizing at least a portion of the reduced nitrogen light cycle oil to produce a catalytically cracked petroleum product of reduced sulfur and nitrogen content that has a lower sulfur and lower nitrogen content by weight than the light cycle oil fraction.

16. A method according to claim 15, wherein the reaction vessel comprises a light cycle oil accumulator connected to the fractionation column to provide reflux of the light cycle oil fraction.

17. A method according to claim 15, wherein the catalytically cracked light cycle oil fraction to be treated with the formaldehyde is withdrawn from the fractionation column and reacted with the formaldehyde in a reaction vessel separate from the fractionation column.

18. A method according to claim 17, wherein at least a portion of the catalytically cracked light cycle oil fraction is returned to the fractionation column after reaction with the formaldehyde.

19. A method according to claim 15, wherein at least a portion of the nitrogen heterocyclic compounds boil within the range of 150° C. to 450° C. and at least a portion of the nitrogen coupling products boil above 450° C.

* * * * *